US006817904B2

(12) United States Patent
Ishikawa et al.

(10) Patent No.: US 6,817,904 B2
(45) Date of Patent: Nov. 16, 2004

(54) CONNECTOR AND A METHOD FOR INSERTING A TERMINAL FITTING THEREINTO

(75) Inventors: Ryotaro Ishikawa, Yokkaichi (JP); Hajime Kawase, Yokkaichi (JP); Yuuichi Nankou, Yokkaichi (JP); Yukihiro Fukatsu, Yokkaichi (JP); Naoya Kurimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 68 days.

(21) Appl. No.: 10/441,659

(22) Filed: May 20, 2003

(65) Prior Publication Data

US 2003/0228797 A1 Dec. 11, 2003

(30) Foreign Application Priority Data

Jun. 6, 2002 (JP) ..... 2002-166360
Jul. 26, 2002 (JP) ..... 2002-218603

(51) Int. Cl.[7] ..... H01R 13/40
(52) U.S. Cl. ..... 439/733.1; 439/595; 439/752.5
(58) Field of Search ..... 439/733.1, 752.5, 439/595

(56) References Cited

U.S. PATENT DOCUMENTS 5,980,328 A * 11/1999 Takanashi et al. ..... 439/733.1
6,439,934 B1 * 8/2002 Yu ..... 439/733.1

FOREIGN PATENT DOCUMENTS

| | | |
|---|---|---|
| EP | 0 386 742 | of 1990 |
| EP | 1 024 557 | of 2000 |
| JP | 2001-332334 | of 2001 |

* cited by examiner

*Primary Examiner*—Tho D. Ta
(74) *Attorney, Agent, or Firm*—Anthony J. Casella; Gerald E. Hespos

(57) ABSTRACT

Female terminal fittings (30) are insertable from behind into cavities (11) in a female housing (10). A slanted guide surface (22) is formed at the peripheral rear edge of each cavity (11) for guiding the female terminal fitting (30) into the cavity (11) and is slanted at an obtuse angle to an inserting direction of the female terminal fitting (30). A stabilizer-inserting groove (20) is formed in a surface of the cavity (11) and has an open rear end into which a stabilizer (47) of the female terminal fitting (30) is insertable. A preventing surface (27) is provided at the peripheral rear edge of the cavity (11) and abuts the stabilizer (47) when the female terminal fitting (30) is inserted in an improper posture. An angle of the preventing surface (27) to the inserting direction is less than an angle of the slanted guide surface (22).

11 Claims, 21 Drawing Sheets

CONNECTOR AND A METHOD FOR INSERTING A TERMINAL FITTING THEREINTO

BACKGROUND OF THE INVENTION

1. Field of the Invention

The invention relates to a connector and a terminal fitting.

2. Description of the Related Art

Japanese Unexamined Patent Publication No. 2001-332334 and FIG. 21 herein show a connector for accommodating terminal fittings. With reference to FIG. 21, the connector has a housing 1 with a rear end surface 1*a* and a cavity 2 extending into the rear end surface 1*a*. The connector also includes a terminal fitting 3 with a stabilizer 4 that can be inserted into a stabilizer-insertion groove 5 in the cavity 2 if the terminal fitting 3 is oriented properly. However, the stabilizer 4 is intended to abut against the rear end 1*a* of a connector housing 1 and hinder insertion if the terminal fitting is oriented improperly. The housing 1 further has a slanted guide surface 6 at the peripheral edge of the rear end of the cavity 2 to guide the properly oriented terminal fitting 3 into the cavity 2. However, the stabilizer 4 also can be guided into the cavity 2 by the inclination of the guide surface 6. Therefore, there has been a possibility that the terminal fitting 3 may be inserted in an improper posture while biting the ceiling wall of the cavity 2.

The invention was developed in view of the above problem and an object thereof is to prevent a terminal fitting from being inserted in an improper posture.

SUMMARY OF THE INVENTION

The invention is directed to a connector with a housing that has at least one cavity formed therein. A terminal fitting is insertable into the cavity in an inserting direction, and a stabilizer projects transversely from the terminal fitting. A slanted guide surface is formed at the peripheral edge of the inserting end of the cavity and is slanted at an angle to the inserting direction of the terminal fitting for guiding the terminal fitting into the cavity. A stabilizer-inserting groove is formed in an inner surface of the cavity and has an open end at the inserting end of the cavity for receiving the stabilizer of the terminal fitting. A preventing surface is provided at the peripheral edge of the inserting end of the cavity, and is disposed so that the stabilizer abuts the preventing surface when the terminal fitting is in an improper posture. The preventing surface is aligned at an angle to the inserting direction that is smaller than the angle of the slanted guide surface to the inserting direction.

A terminal fitting held in a proper inserting posture is guided into the cavity by the slanted guide surface and the stabilizer aligns with the stabilizer-inserting groove. Thus, the terminal fitting can be inserted smoothly into the cavity. On the other hand, the stabilizer of an improperly oriented terminal fitting abuts against the preventing surface, and the improperly oriented terminal fitting cannot be inserted into the cavity. The angle of the preventing surface to the inserting direction is smaller than the angle of the slanted guide surface to the inserting direction. Thus, the stabilizer is less likely to be guided into the cavity and insertion of the improperly oriented terminal fitting is prevented.

The slanted guide surface preferably is slanted at an obtuse angle to the inserting direction of the terminal fitting.

The preventing surface preferably is arranged point-symmetrical with respect to the stabilizer-inserting groove or symmetrical to the stabilizer-inserting groove with respect to an insertion axis of the terminal fitting.

The angle of the preventing portion is about 90° with respect to the inserting direction. Thus, the stabilizer can come into surface contact with the preventing portion and/or an inserting end surface of the housing.

The preventing portion and an inserting end surface of the housing preferably are substantially continuous and flush with each other.

The preventing portion preferably is arranged to contact the stabilizer in a way to avoid a contact of a locking projection of the terminal fitting with the connector housing if the terminal fitting is oriented improperly during insertion.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A first embodiment of a female connector according to the invention is described with reference to FIGS. 1 to 18. The female connector includes a female housing 10 into which one or more female terminal fittings 30 are insertable. The female housing 10 is configured to connect with a male housing so that the female terminal fittings 30 are electrically connectable with male terminal fittings in the male housing (neither male terminal fittings nor male housing is shown). In the following description, directions of inserting and withdrawing the female terminal fittings 30 into and from the female housing 10 are referred to as a forward direction and a backward direction, respectively, and reference is made to FIG. 7 concerning vertical direction.

Figure 1:
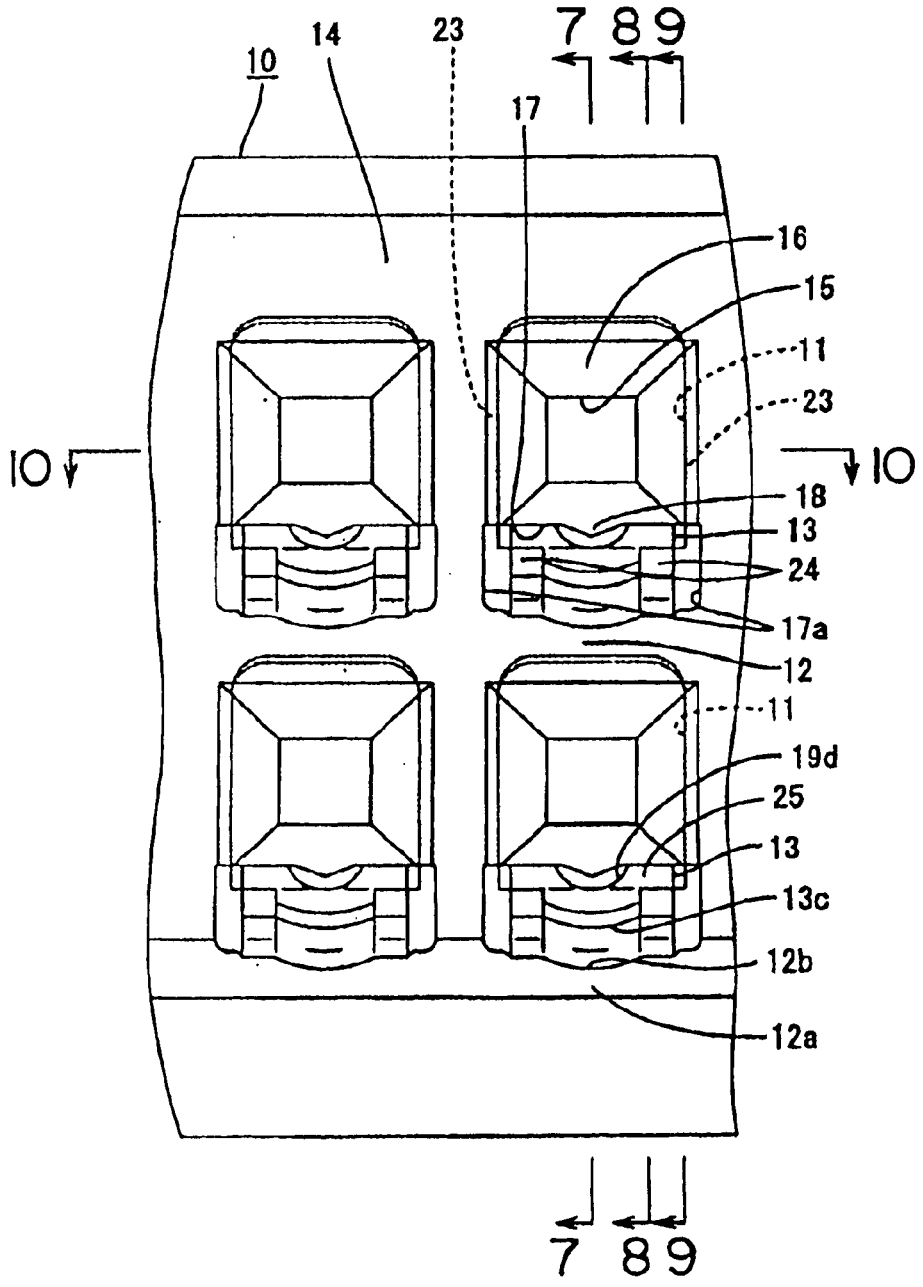
FIG. 1 is a front view of a female housing according to one embodiment of the invention.

The female housing 10 is molded e.g. of a resin by front and rear molds that close and open substantially along forward and backward directions, which are parallel to the inserting and withdrawing directions IWD of the female terminal fittings 30. Cavities 11 are arranged substantially side by side along a widthwise direction at two stages in the female housing 10, as shown in FIG. 1, and a resilient lock 13 cantilevers forward from a bottom wall 12 of each cavity 11. The female terminal fittings 30 are insertable from behind into the respective cavities 11 and are held in the cavities 11 by the respective locks 13. Additionally, the female terminal fitting 30 is supported at its front-limit position by a front wall 14 of the female housing 10. The front wall 14 is formed with tab insertion holes 15 so that tabs of the mating male terminal fittings can be inserted into the cavities 11 from the front. Conical converging guide surfaces 16 are formed at the front edges of the tab insertion holes 15 substantially over the entire periphery so that the tabs can be inserted smoothly. Mold removal holes 17 are formed on the front wall 14 of the female housing 10 below the tab insertion holes 15 and in positions displaced in a deforming direction DD of the locks 13. The mold-removal holes 17 are used to remove the front mold for molding the locks 13. A substantially triangular projection 18 projects down at a widthwise center of the upper end of each mold-removal hole 17 in the front wall 14, and the guide surface 16 is formed continuously at the projection 18.

About ¼ of a front portion of the bottom wall 12 of each cavity 11 is formed to be lower down to form a stepped or lowered portion 12*a*, and the cantilevered lock 13 projects forward from the resulting lowered portion 12*a*. The lock 13 is inclined up to the front and the front end of the lock 13 gradually projects into the cavity 11. The lock 13 is resiliently deformable down in a deformation direction DD that intersects the inserting and withdrawing directions IWD of the female terminal fitting 30. More particularly, the lock 13 is deformable about a rear end as a supporting point when the front end of the lock 13 is pressed by the female terminal fitting 30 being inserted into the cavity 11. During this resilient deformation, the lock 13 is retracted into a deformation permitting space defined in the lowered portion 12*a* of the bottom wall 12. The lowered portion 12*a* of the bottom wall 12 that faces the lock 13 from below prevents an excessive resilient deformation of the lock 13 by engaging the lower surface of the lock 13 before the lock 13 undergoes a resilient deformation beyond its resiliency limit. The lock 13 is covered by the lowered portion 12*a* of the bottom wall 12 connected with the front wall 14 over substantially the entire width without being exposed to the cavity 11 located below or to the outside below the female housing 10.

Figure 2:
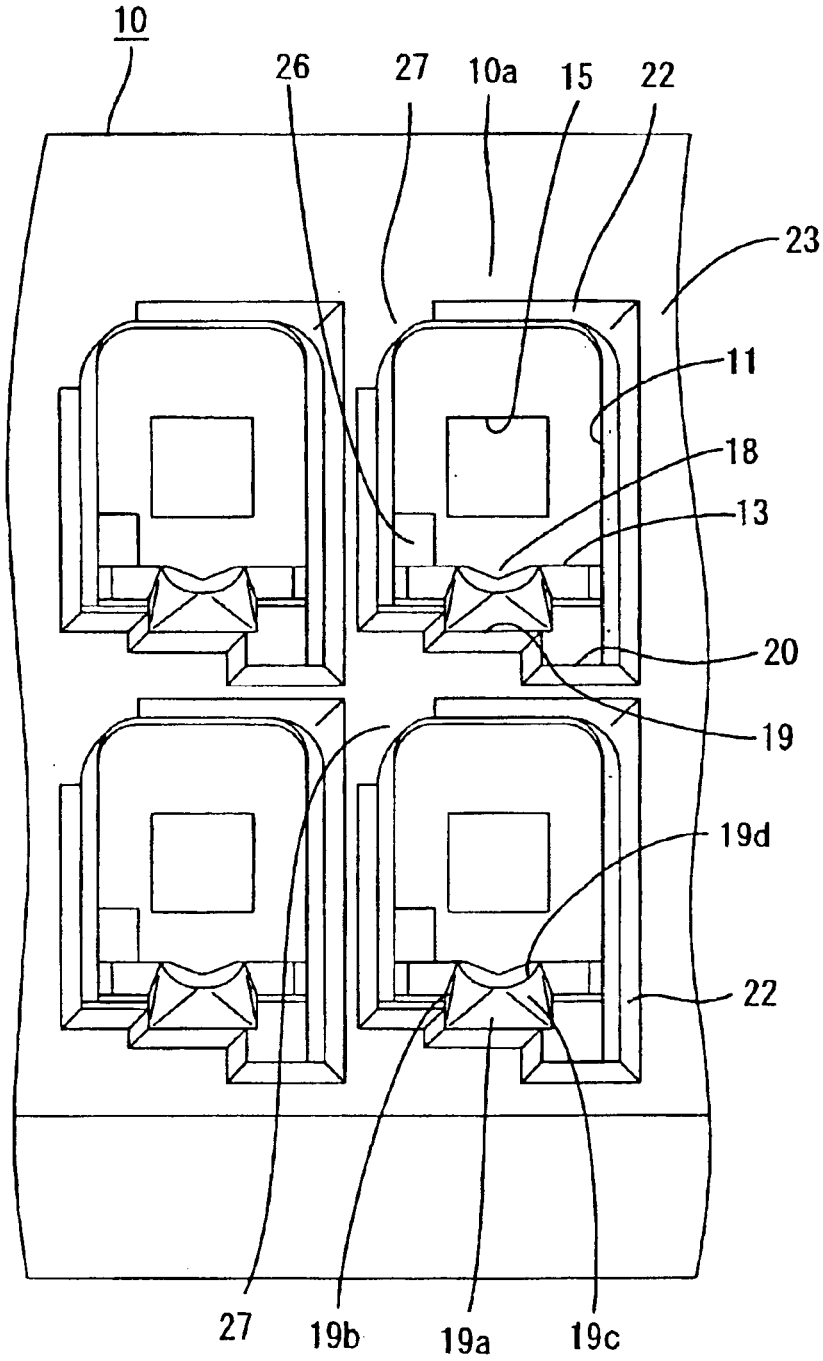
FIG. 2 is a rear view of the female housing.
Figure 8:
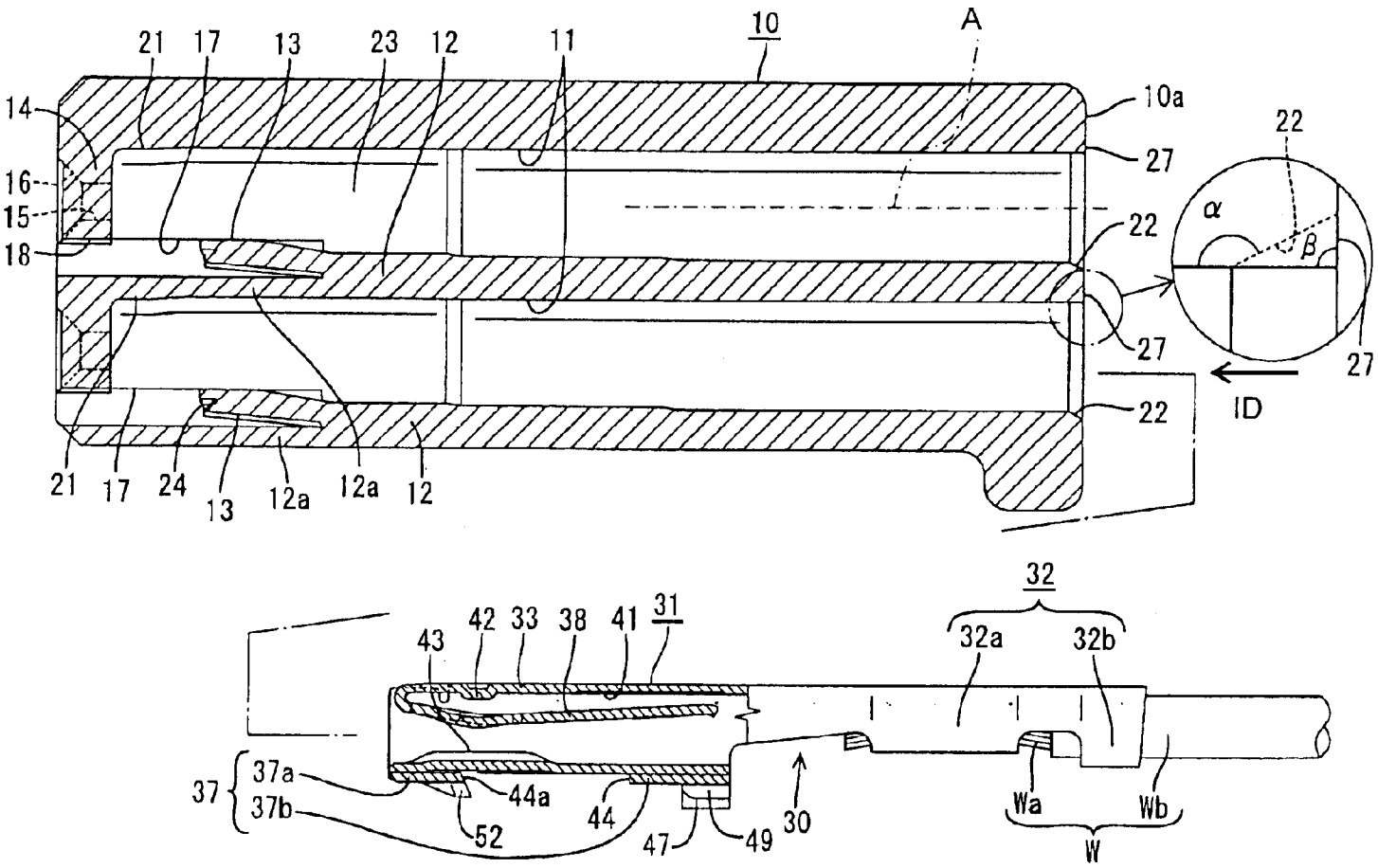
FIG. 8 is a side view in section (the female housing is shown by a section along 8—8 of FIG. 1 and the female terminal fitting is shown by a section along 8—8 of FIG. 4) in the state before the female terminal fitting is inserted into the housing.

Grooves are formed at a portion of the bottom wall 12 of the cavity 11 behind the lock 13 and the grooves conform to the shape of the female terminal fitting 30, as shown in FIGS. 2 and 8. Specifically, a projection-inserting groove 19 is formed substantially in the widthwise center of the bottom wall 12, and a stabilizer-inserting groove 20, which is deeper than the projection-inserting groove 19, is formed at the right side of the projection-inserting groove 19 in FIG. 2. The projection-inserting groove 19 is substantially continuous with the lock 13, whereas the front end position of the stabilizer-inserting groove 20 is slightly behind the lock 13. The bottom wall 12, the projection-inserting groove 19 and the stabilizer-insertion groove 20 define a stair-like shape in widthwise direction (see FIG. 2).

Figure 11:
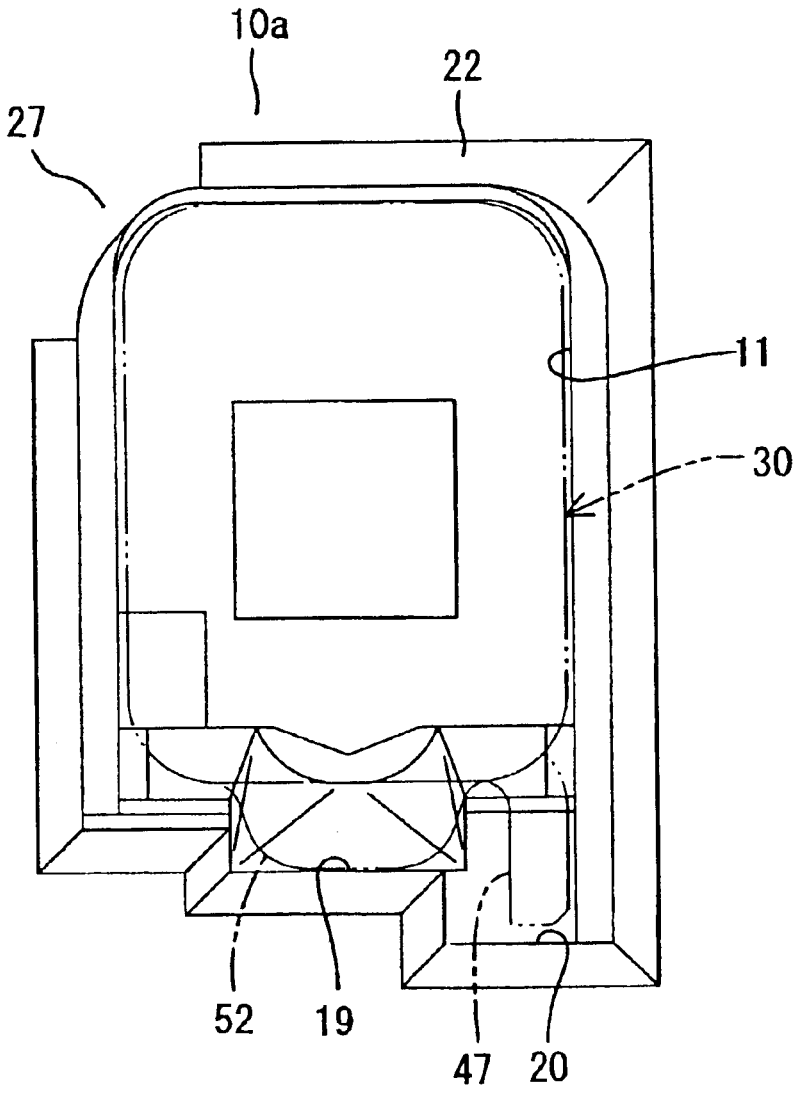
FIG. 11 is a rear view showing a relationship between the female terminal fitting having a proper insertion posture and the cavity.
Figure 12:
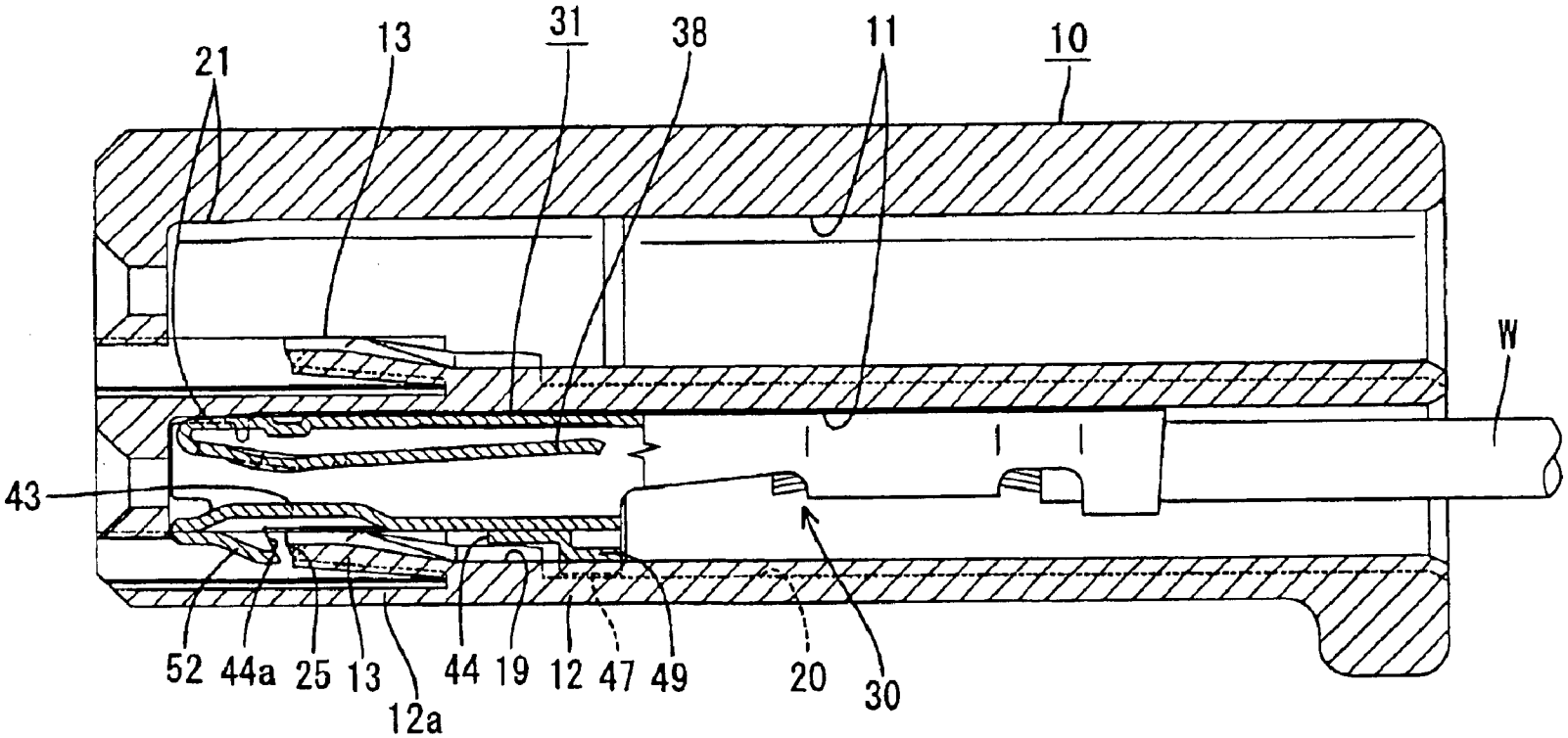
FIG. 12 is a side view in section similar to FIG. 7, but showing the female terminal fitting inserted to a proper depth in the female housing.
Figure 13:
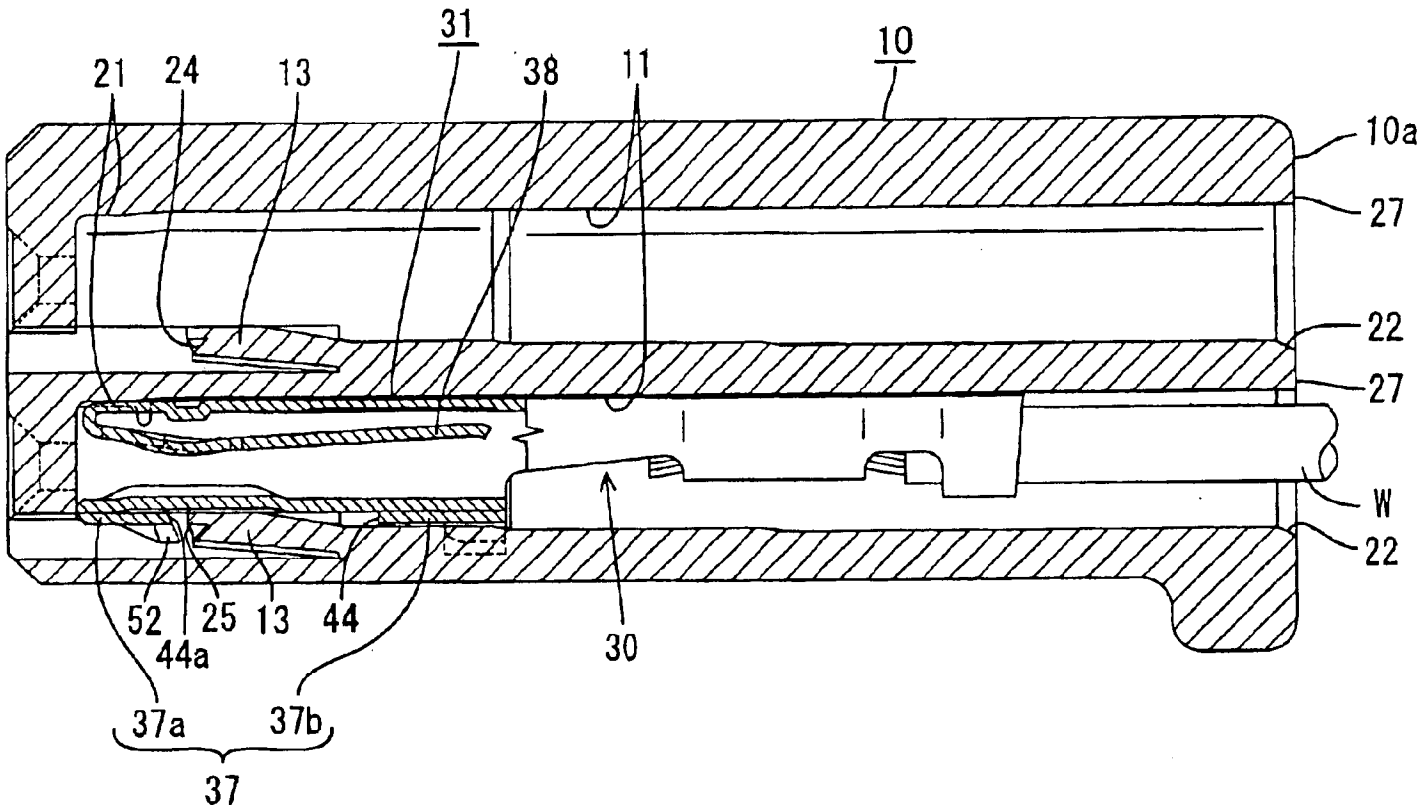
FIG. 13 is a side view in section similar to FIG. 8, but showing the female terminal fitting inserted to the proper depth in the female housing.
Figure 14:
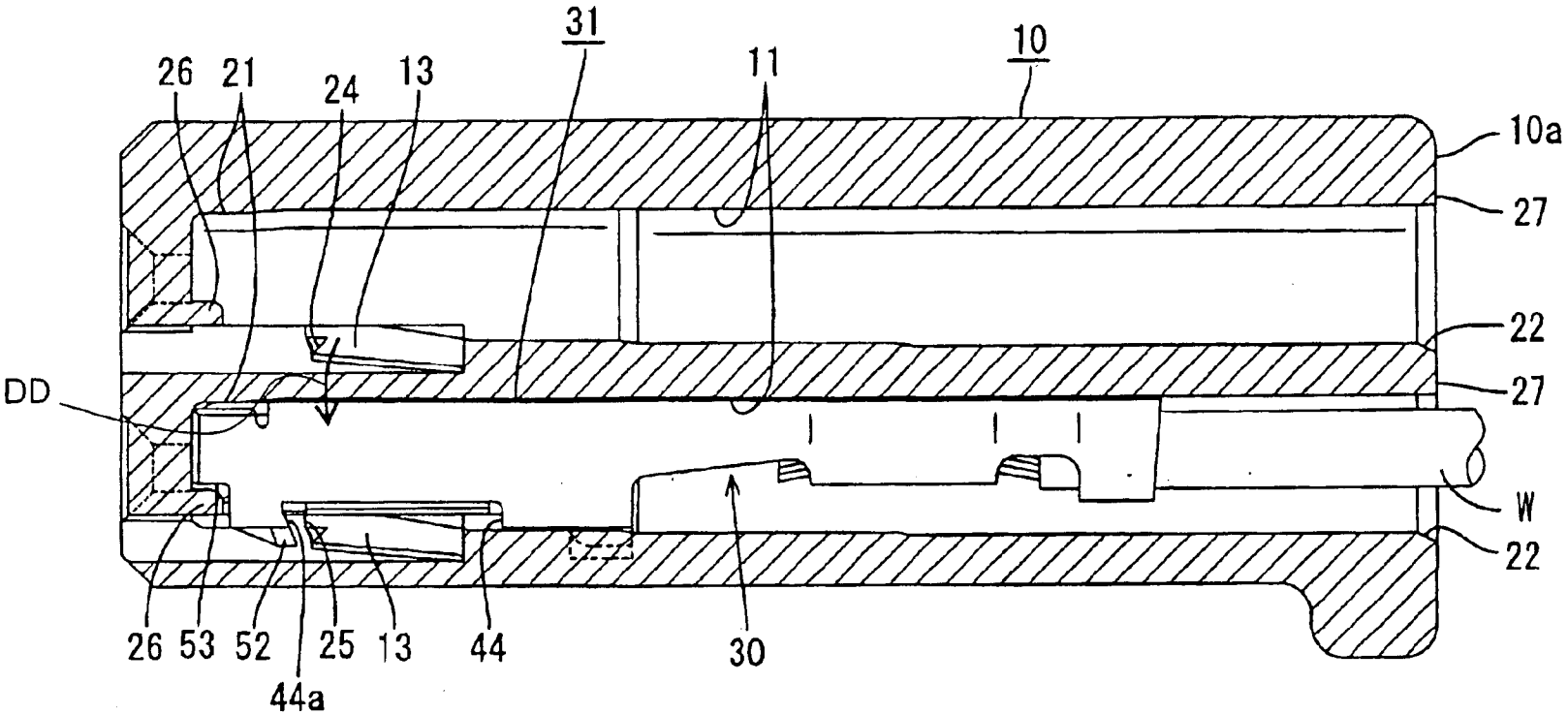
FIG. 14 is a side view in section similar to FIG. 9, but showing the female terminal fitting inserted to the proper depth in the female housing.

A jutting portion 21 is provided at the front end of the upper surface of the cavity 11 and gradually projects in toward the lock 13 over the entire width. The front end of the female terminal fitting 30 inserted into the cavity 11 is pushed toward the lock 13 by the jutting portion 21 to increase a depth of engagement with the lock 13. The peripheral edge of the rear end of the cavity 11 inclines in to the front over substantially the entire periphery except to guide the female terminal fitting 30. A restriction 22 is provided at an upper-left position of the peripheral edge of the rear end of the cavity 11 in FIG. 2 and extends substantially normal to the inserting and withdrawing directions IWD of the female terminal fitting 30. Further, opposite side walls 23 of the cavity 11 bulge inwardly so that a substantially front half is narrower than a substantially rear half as shown in FIG. 11.

Figure 3:
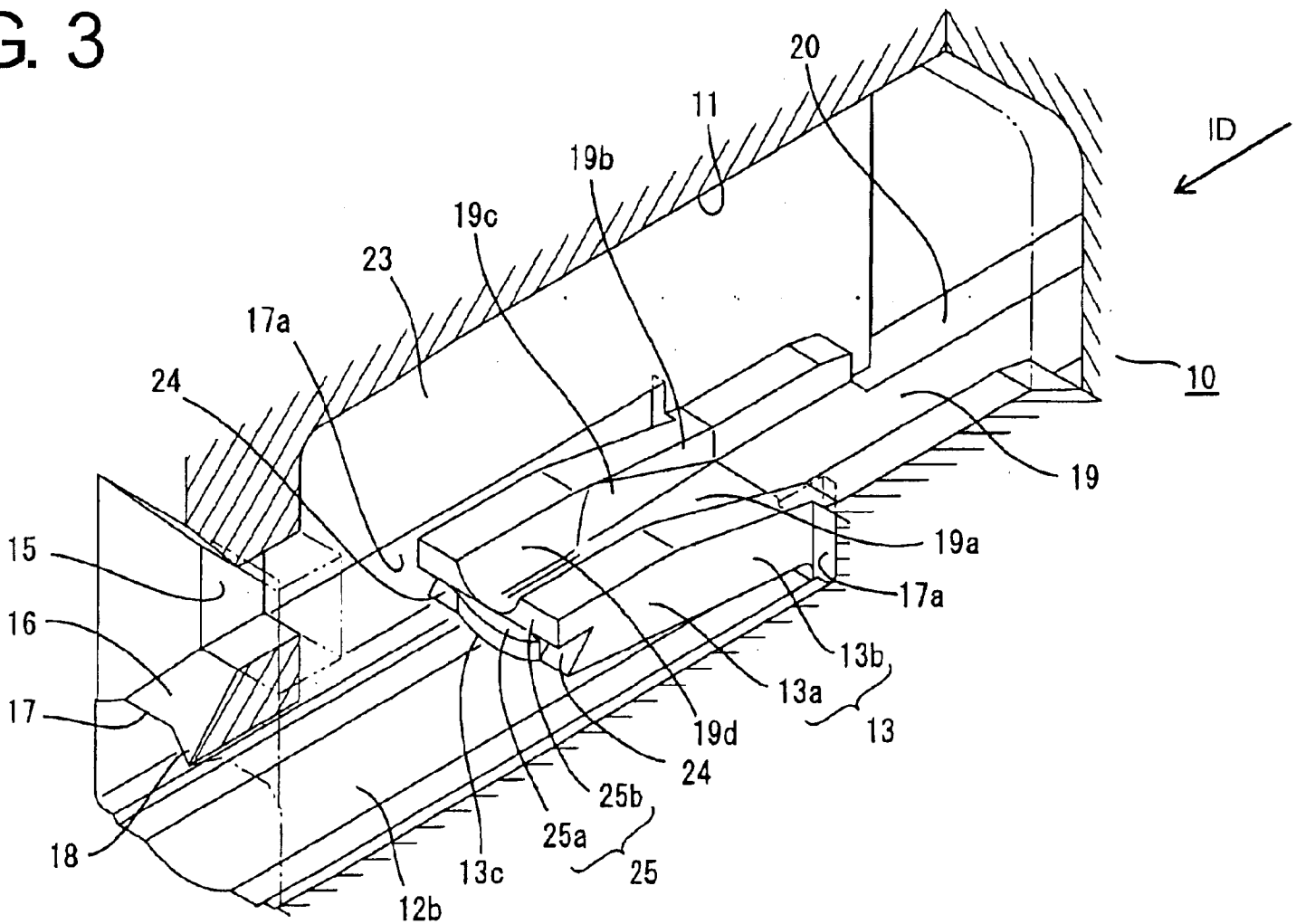
FIG. 3 is a perspective view partly in section of the female housing.

The lock 13, as shown in FIG. 3, has a lower surface that is inclined moderately up to the front over substantially the entire length. The upper surface of the lock 13 is slanted slightly steeper than the lower surface at a rear part 13*b* of the lock 13, but is substantially parallel to the inserting and withdrawing directions IWD of the terminal fitting 30 at a front part 13*a* of the lock 13. The upper surface of the lock 13 is recessed substantially at the widthwise center over the entire length by the projection-inserting groove 19 that extends continuously from the rear of the bottom wall 12. The projection-inserting groove 19 narrows gradually from the rear 13*b* of the lock 13 to the front and has a bottom surface 19*a*, a pair of side surfaces 19*b* extending straight in a vertical direction and a pair of slanted surfaces 19*c* that incline inwardly to couple the opposite side surfaces 19*b* and the bottom surface 19*a*. The projection-introducing groove 19 has an arcuate surface 19*d* of constant width at the front part 13*a* of the lock 13. An arcuate surface 13*c* is formed at the widthwise center of the lower surface of the lock 13 and is curved more moderately than the arcuate surface 19*d* of the projection-introducing groove 19. The arcuate surface 13*c* extends along the entire length. A similar arcuate surface 12*b* is formed at the lowered portion 12*a* of the bottom wall 12.

The lock 13 has a constant width and is slightly narrower than the cavity 11. The mold-removal hole 17 for the lock 13 is wider than the cavity 11 in the front wall 14 of the female housing 10. Accordingly, notches 17*a* of a specified width are formed in the opposite side walls 23 of the cavity 11 substantially facing the opposite sides of the lock 13. The thickness of the mold for molding the lock 13 can be made larger as much as the widths of the notches 17*a* and, thus, a necessary strength can be secured for the mold. Conversely, the width of the lock 13 is increased to enhance the strength thereof.

Two maneuverable recesses 24 are exposed forward at about ⅗ of the total height of the opposite sides of the front end of the lock 13 and enable the lock 13 to be deformed by a jig (not shown). Additionally, the maneuverable recesses 24 are exposed forwardly to the outside even if the lock 13 is engaged with the female terminal fitting 30 (see FIG. 17), and can be pressed down in the deformation direction DD by the jig inserted through the mold-removal hole 17 from the front. Each maneuverable recess 24 is substantially triangular when the lock 13 is viewed sideways. Thus, the upper surface of each maneuverable recess 24 is substantially horizontal, whereas the lower surface thereof is inclined up and to the back (see FIG. 3).

A projection 25 projects forward from the upper part of the front end of the lock 13 and has a height of about ⅔ of the total height of the front end of the lock 13. The projection 25 has a lower part 25*a* with projecting length that gradually increases toward the upper end and an upper part 25*b* above the maneuverable recesses 24 that has a constant projecting length. Thus, the front end surface of the lower part 25*a* of the projection 25 is a slanted up and to the front, whereas the front end surface of the upper part 25*b* is substantially vertical. The upper part 25*b* extends across the entire width of the lock 13.

Figure 10:
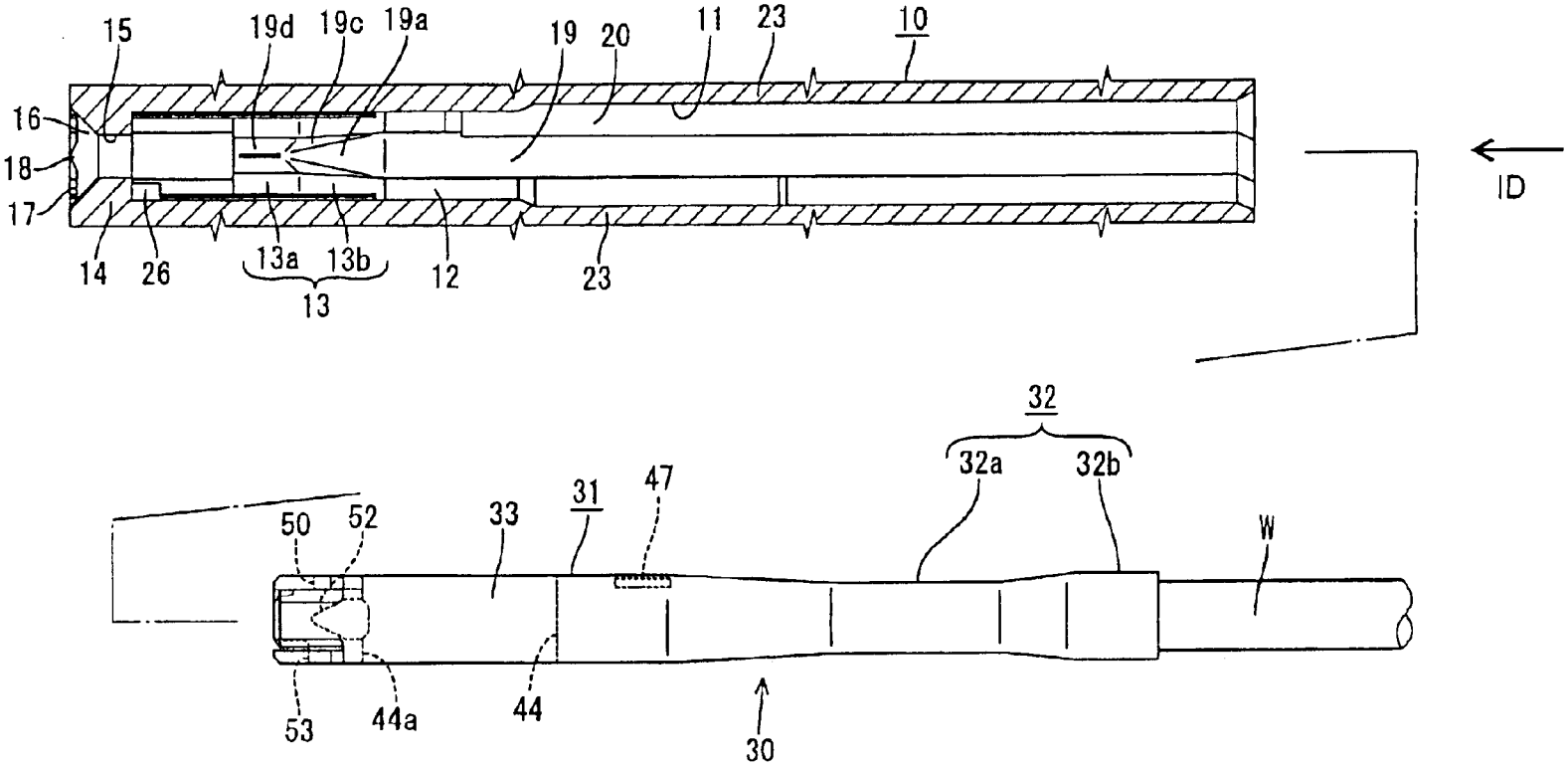
FIG. 10 is a plan view in section (the female housing is shown by a section along 10—10 of FIG. 1 and the female terminal fitting is shown by a plan view) in the state before the female terminal fitting is inserted into the housing.

A substantially block-shaped support 26 projects in from a corner at the front end of the cavity 11, as shown in FIGS. 2 and 10, and prevents the female terminal fitting 30 from being inclined vertically. The support 26 is coupled to the front wall 14 of the female housing 10 and the left side wall 23 of the cavity 11 to enhance the strength of the support 26. The lower surface of the support 26 faces the mold-removal hole 17.

Figure 5:
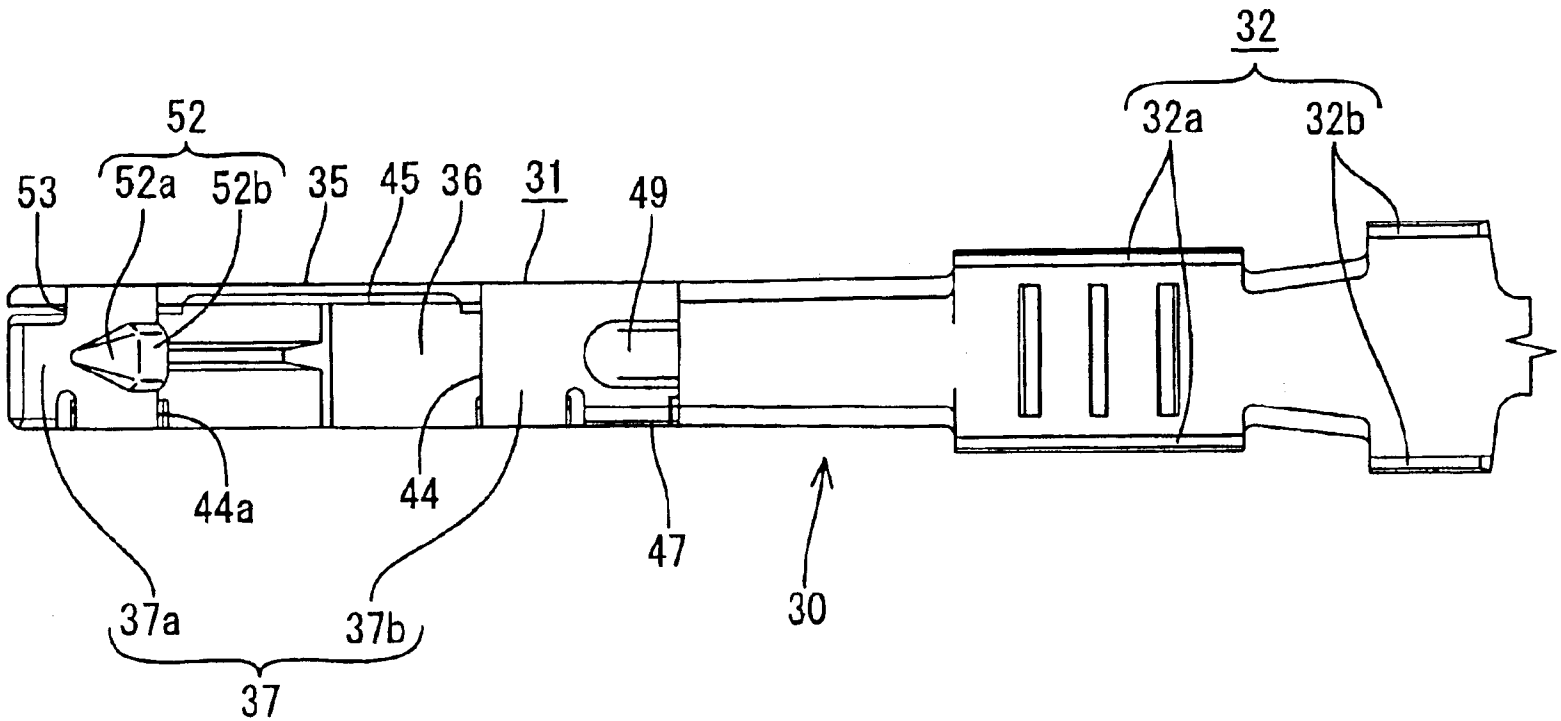
FIG. 5 is a bottom view of the female terminal fitting.

The female terminal fitting 30 is formed into a desired shape by, for example, embossing, folding and/or bending a metallic material stamped or cut out into a specified shape. This female terminal fitting 30, as shown in FIGS. 5 and 8, has a main body 31 substantially in the form of a box with open front and rear ends. A barrel 32 is connected to the rear end of the main body 31 and is configured to be crimped, bent or folded into connection with an end of a wire W. The barrel 32 has a front pair of crimping pieces 32*a* for connection with a core Wa of the wire W, and a rear pair of crimping pieces 32*b* for connection with an insulated portion Wb of the wire W.

Figure 4:
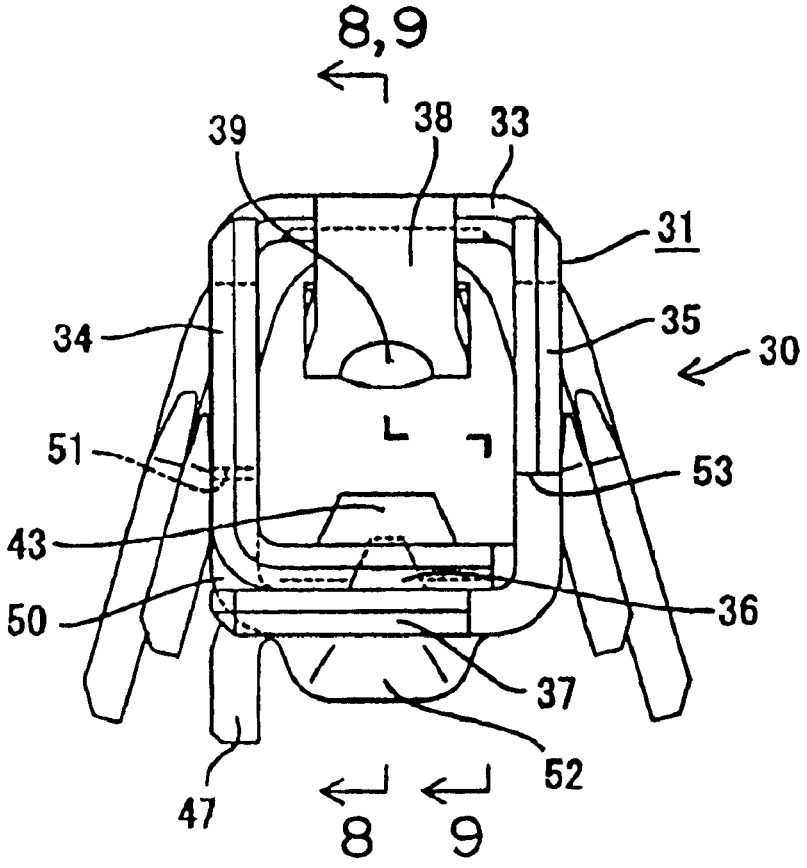
FIG. 4 is a front view of a female terminal fitting.

The main body 31 has a ceiling wall 33 that extends forward and backward, side walls 34, 35 that extend down from lateral edges of the ceiling wall 33, a bottom wall 36 that projects from a projecting end of the left side wall 34 of FIG. 4 to face the ceiling wall 33, and an outer wall 37 that projects from a projecting end of the right side wall 34 of FIG. 4 to lie outside of the bottom wall 36.

The front end of the ceiling wall 33 is retracted back as compared to the front ends of the other walls 34, 35, 36 and 37, and a resilient contact piece 38 projects from a U-shaped fold at the front end of the ceiling wall 33, as shown in FIG. 8. The resilient contact piece 38 faces the ceiling wall 33 and the bottom wall 36, and is supported only at the front end of the ceiling wall 33. Additionally, the resilient contact piece 38 has a forward-inclined portion rearward of the U-shaped fold and a backward-inclined portion rearward of the forward-inclined portion. A bulge 39 is embossed in the resilient contact piece 38 to project toward the bottom wall 36 and to extend from the forward-inclined portion to the backward-inclined portion. The bulge 39 is substantially an ellipse that is narrow in forward and backward directions. A contact 40 is at the peak of the bulge 39 and can contact the tab of the mating male terminal fitting. The resilient contact piece 38 deforms resiliently as the contact 40 is pressed by the tab of the male terminal fitting. Thus, the resilient contact piece 38 approaches the ceiling wall 33 with the fold as a supporting point of the resilient deformation. The end of the resilient contact piece 38 can contact the inner surface of the ceiling wall 33 during the resilient deformation. A recess 41 is formed in the ceiling wall 33 for enlarging a degree of resilient deformation of the resilient contact piece 38 and for preventing the deformed resilient contact piece 38 from widthwise displacement.

An excessive deformation preventing projection 42 is embossed in the ceiling wall 33 and projects toward the contact portion 40. Excessive resilient deformation of the resilient contact piece 38 beyond its resiliency limit is prevented by the engagement of the resilient contact piece 38 with the excessive deformation preventing projection 42. Further, a receiving portion 43 bulges toward the resilient contact piece 38 from a position on the bottom wall 36 facing the bulge 39. The tab of the male terminal fitting can be squeezed and held between the receiving portion 43 and the resilient contact piece 38.

The outer wall 37 is divided into a front portion 37*a* and a rear portion 37*b* by a cut-away 44 formed over substantially the entire width at a substantially longitudinal middle portion, as shown in FIGS. 5 and 8. The lock 13 can enter the cut-away portion 44 over the entire length of the cut-away portion 44 when the female terminal fitting 30 is inserted into the cavity 11, and hence the lock 13 can engage a front cut end surface 44*a* of the cut-away portion 44. The front cut end surface 44*a* of the cut-away portion 44 serves as a locking surface for engaging the lock 13 and is inclined in and up to the back over its entire area. The cut-away portion 44 has a length slightly less than half the length of the outer wall 37 and extends up to the bottom end of the side wall 35 at the upper side in FIG. 5. A bulging piece 45 projects from the projecting end of the bottom wall 36 and contacts the bottom end surface of the side wall 35 to hold the bottom wall 36 substantially horizontal. The entire bottom wall 36 except a contact portion of the bulging piece 45 with the side wall 35 is slightly lower than this contact portion, thereby increasing a depth of engagement with the lock 13. The front portion 37*a* of the outer wall 37 is slightly shorter than the rear portion 37*b* in forward and backward directions.

Figure 6:
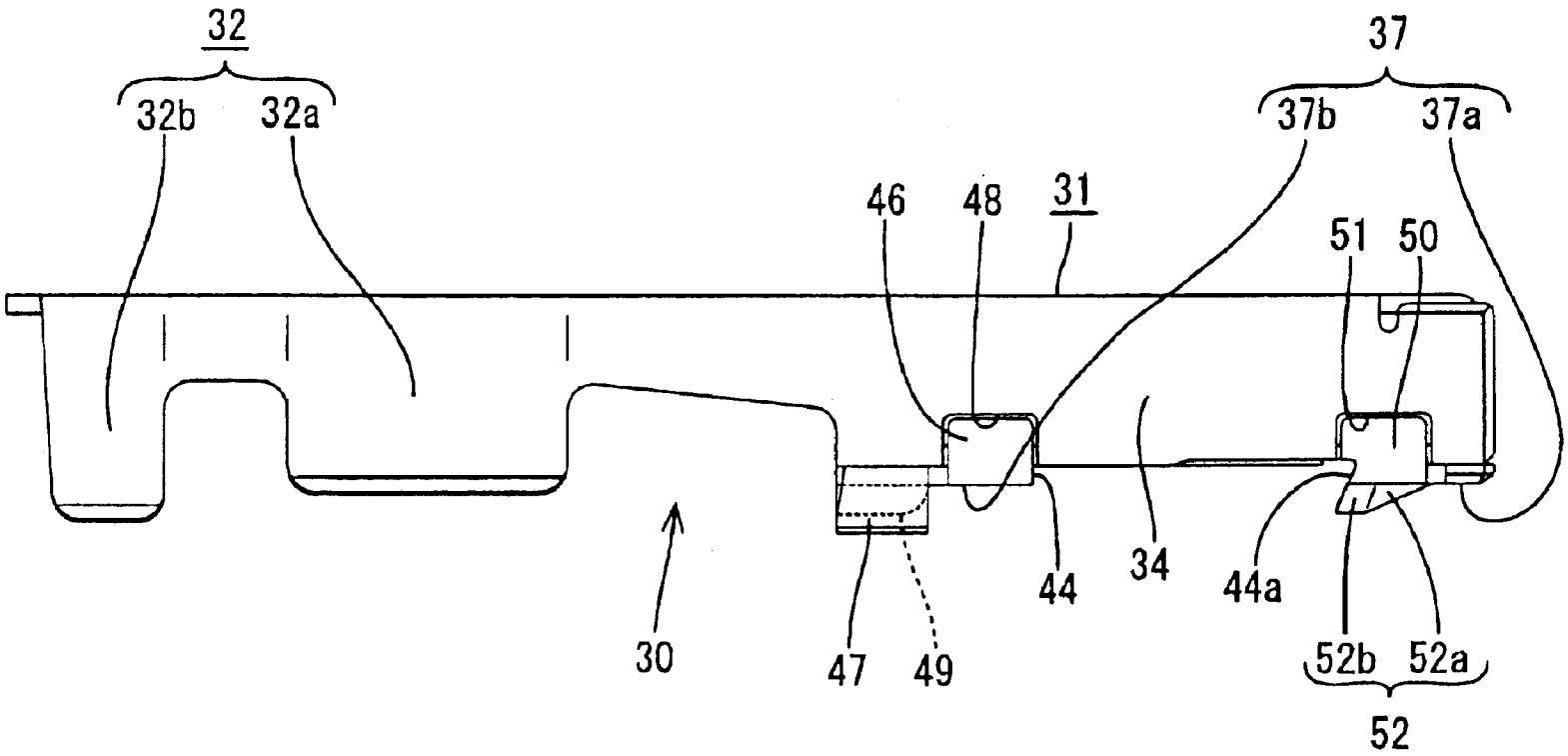
FIG. 6 is a left side view of the female terminal fitting.

A rear-portion holding piece 46 and a stabilizer 47 are provided one after the other at the projecting end of the rear portion 37*b* of the outer wall 37, as shown in FIGS. 5 and 6. The rear-portion holding piece 46 is bent in toward the ceiling wall 33 and the stabilizer 47 is bent out. The rear-portion holding piece 46 fits in a rear-portion holding groove 48 in the side wall 34, as shown in FIG. 6, and hence prevents the rear portion 37*b* from making loose forward and backward movements along the longitudinal direction of the terminal fitting 30. The stabilizer 47 can slide along the stabilizer-inserting groove 20 in the cavity 11 to guide the insertion of the female terminal fitting 30. The front end of the rear-portion holding piece 46 and the front end of the rear portion 37*b* substantially align with each other, whereas the rear end of the stabilizer 47 and the rear end of the rear portion 37*b* substantially align with each other. A projection 49 is embossed to project out from a widthwise center of the rear end of the rear portion 37*b* and has a length substantially equal to the length of the stabilizer 47. The projection 49 contacts the bottom surface of the cavity 11 (upper surface of the projection-inserting groove 19) when the female terminal fitting 30 is inserted into the cavity 11.

Figure 7:
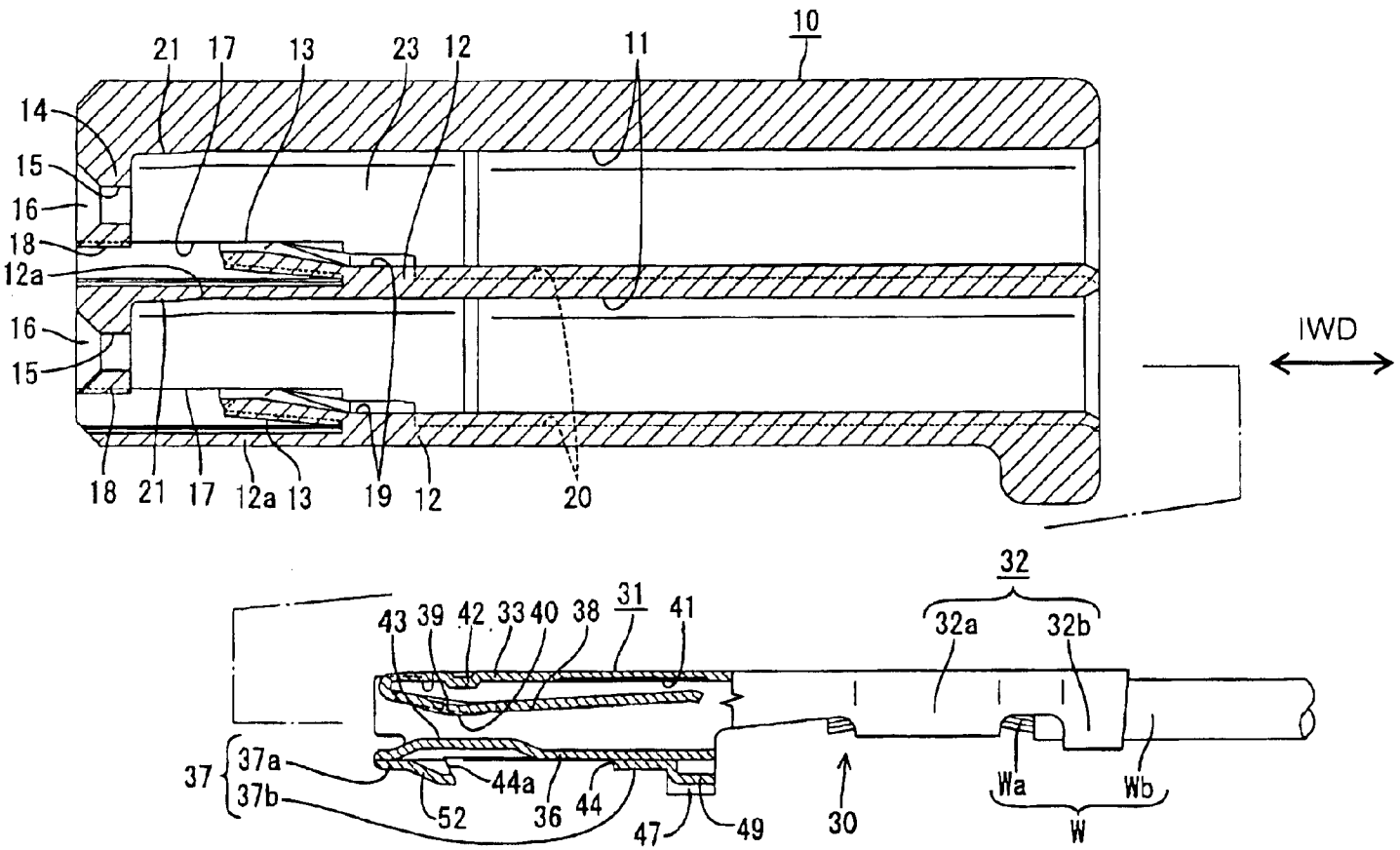
FIG. 7 is a side view in section (the female housing is shown by a section along 7—7 of FIG. 1 and the female terminal fitting is shown by a section along 7—7 of FIG. 4) in a state before the female terminal fitting is inserted into the housing.

A locking projection 52 is embossed to project out at a position slightly displaced to the left side of FIG. 4 from the center of the rear end of the front portion 37*a* of the outer wall 37, and hence at the front cut end of the cut-away portion 44. The locking projection 52 is engageable with the lock 13. The locking projection 52, as shown in FIGS. 5 to 7, has a pyramid portion 52*a* formed by three slanted surfaces and, a substantially rectangular tube portion 52*b* with a substantially constant width and height formed by three side surfaces connected one after the other. The pyramid portion 52*a* of the locking projection 52 is tapered so that the width and height of the locking projection 52 gradually decrease toward the front. The front end of the pyramid portion 52*a* defines a slightly rounded vertex so that the locking projection 52 can be inserted smoothly along the projection-inserting groove 19 in the process of inserting the female terminal fitting 30 into the cavity 11. The substantially rectangular tube portion 52*b* of the locking projection 52 overhangs backward substantially along the inclination of the front cut end surface 44*a* of the cut-away portion 44 and projects more back towards the cut-away portion 44 than the front portion 37*a* of the outer wall 37. Thus, the locking projection 52 is substantially parallel to the front cut end surface 44*a*, which is tapered to incline inwardly at an angle α with respect to the insertion and withdrawal directions IWD, see FIG. 6.

Figure 9:
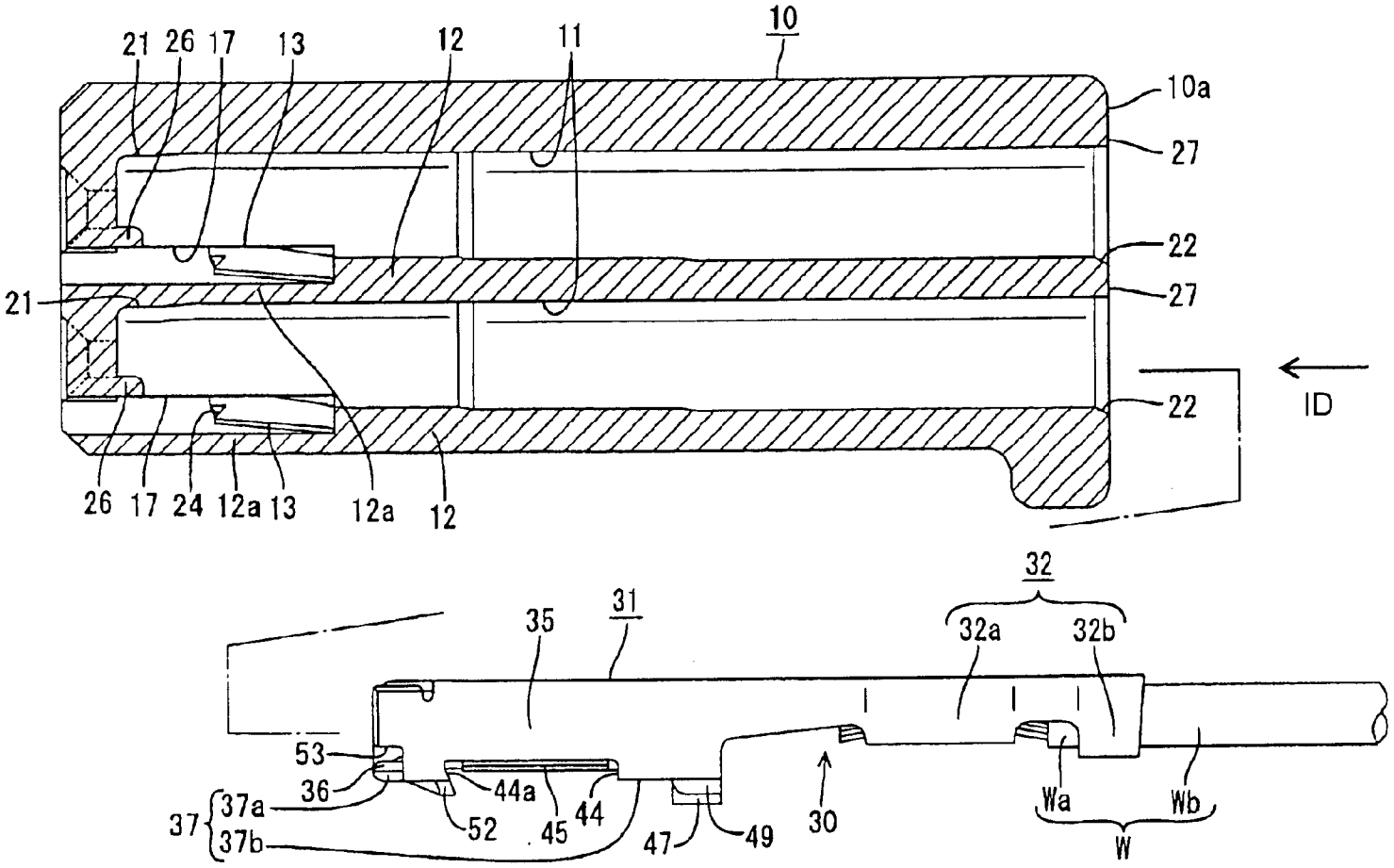
FIG. 9 is a side view in section (the female housing is shown by a section along 9—9 of FIG. 1 and the female terminal fitting is shown by a right side view) in the state before the female terminal fitting is inserted into the female housing.

The locking projection 52 projects up to substantially the same height as the projection 49, and, like the projection 49, is insertable into the projection-inserting groove 19 of the cavity 11. The outward-projecting end of the rectangular tube portion 52*b* of the locking projection 52 is set to reach a part of the lock 13 below the projection 25, thus ensuring a sufficient depth of engagement with the lock 13. The rear end 52*c* of the locking projection 52 defines a locking surface that engages the lock 13. The rear end 52*c* is formed by the front cut end surface 44*a* of the cut-away portion 44 and inclines in and up to the back. The rear end surfaces of the portions of the front portion 37*a* of the outer wall 37 at the opposite sides of the locking projection 52 also are formed by the front cut end surface 44*a* of the cut-away portion 44 inclined in and up to the back. These rear end surfaces are engageable with the lock 13, as shown in FIG. 9.

The fittable groove 53 opens forward at a corner between the front portion 37*a* of the outer wall 37 and the right side wall 35 of FIG. 4. Thus, the fitting groove 53 is at the corner at a side opposite from the ceiling wall 33 provided with the resilient contact piece 38 with respect to height direction and at a side opposite from the front-portion holding piece 50 with respect to the widthwise direction. The supporting projection 26 at the front end of the cavity 11 is engageable with the fittable groove 53 as the female terminal fitting 30 is inserted into the cavity 11. Thus, the female terminal fitting 30 is supported so as not to move loosely along a direction that intersects the inserting and withdrawing directions of the female terminal fitting 30, deforming direction of the locking portion 13.

A slanted guide surface 22 is formed at the rear end of the cavity 11 for guiding the female terminal fitting 30 into the cavity 11 and extends around the entire periphery of the cavity 11 except for the left-upper corner in FIG. 2. The slanted guide surface 22 defines an angle α to an inserting direction ID of the female terminal fitting 30 into the cavity 11 that preferably is 90° or larger, i.e. an obtuse angle. A preventing surface 27 is formed at the left-upper corner of the peripheral edge at the rear end of the cavity 11 in FIG. 2, and hence is at a location where the slanted guide surface 22 is not formed. The preventing surface abuts against the stabilizer 37 when an attempt is made to insert the female terminal fitting 30 into the cavity 11 while holding the female terminal fitting 30 in an inverted rotational posture. The preventing surface 27 is substantially continuous with a rear end surface 10*a* of the female housing 10 and extends substantially normal to the inserting direction ID of the female terminal fitting 30 into the cavity 11. Specifically, an angle β of the preventing surface 27 to the inserting direction ID of the female terminal fitting 30 into the cavity 11 is about 90°. Accordingly, the angle β of the preventing surface 27 to the inserting direction ID is smaller than the angle α of the slanted guide surface 22 to the inserting direction. The preventing surface 27 is point-symmetrical (diagonally positioned) with respect to the stabilizer-inserting groove 20 at the right-lower corner of the cavity 11 in FIG. 2. Thus, the preventing surface 27 is arranged substantially symmetrical to the stabilizer-inserting groove 20 with respect to an insertion axis A of the terminal fitting 30 into the respective cavity 11.

The connector is assembled by first crimping the barrel 32 of the female terminal fitting 30 into connection with the wire W, and then inserting the female terminal fitting 30 into the cavity 11 from behind, as shown in FIGS. 7 to 10. The female terminal fitting 30 is inserted into the cavity 11 while oriented with the stabilizer 47 facing down and is substantially aligned with the stabilizer-inserting groove 20, as shown in FIG. 11. Thus, the female terminal fitting 30 is guided into the cavity 11 by the slanted guide surface 22. The locking projection 52 is introduced into the projection-inserting groove 19 and then the projection 49 and the stabilizer 47 are introduced into the projection-inserting groove 19 and the stabilizer-inserting groove 20, respectively. As a result, the female terminal fitting 30 can be inserted smoothly and is prevented from shaking vertically along directions substantially normal to the inserting direction ID. The lock 13 is pressed down and deformed by the locking projection 52 when the female terminal fitting 30 is inserted to a specified depth. Maximum deformation of the lock 13 in the deformation direction DD occurs when the locking projection 52 presses the front part 13*a* of the lock 13. During this process, the locking projection 52 is inserted smoothly along the projection-inserting groove 19 and the substantially pyramidal shape with the vertex at the front end smoothly presses the lock 13.

Figure 15:
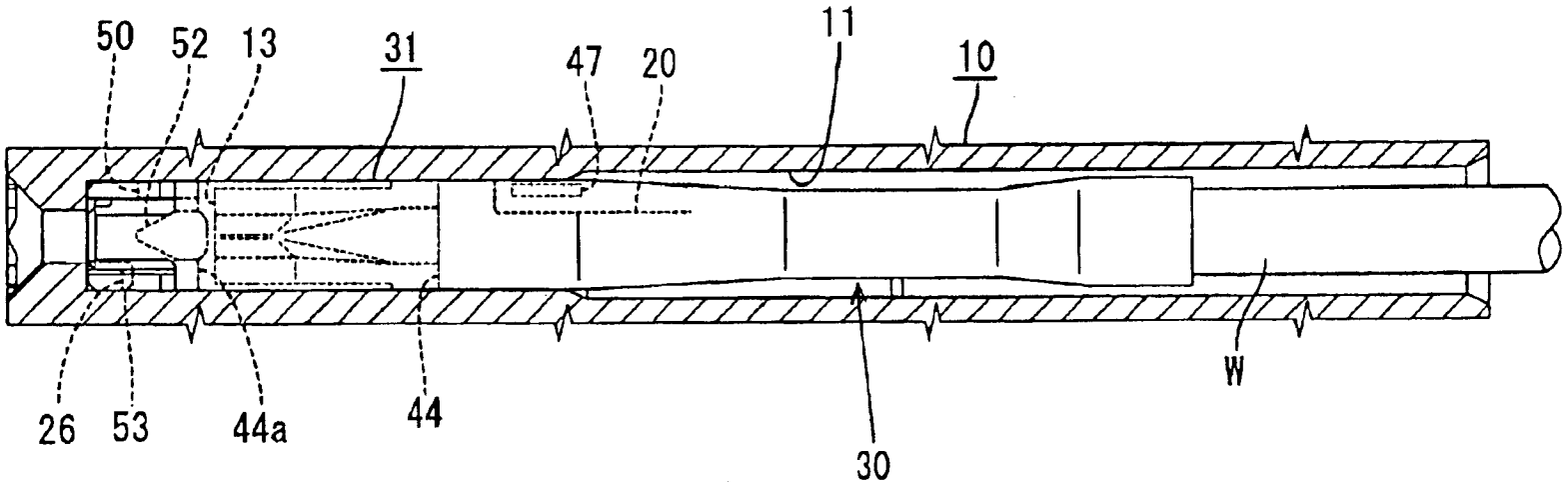
FIG. 15 is a plan view in section similar to FIG. 10, but showing the female terminal fitting inserted to the proper depth in the female housing.
Figure 16:
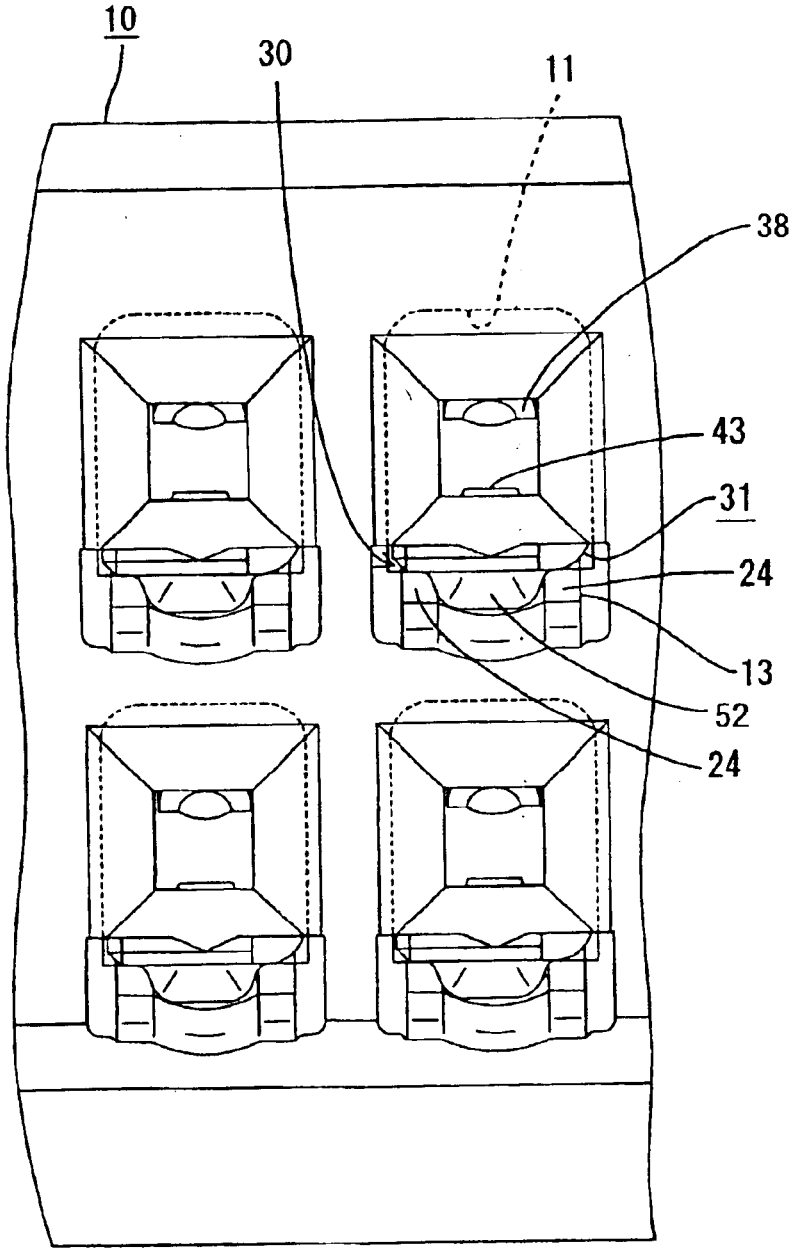
FIG. 16 is a front view showing a state where the female terminal fittings are inserted in the female housing.
Figure 17:
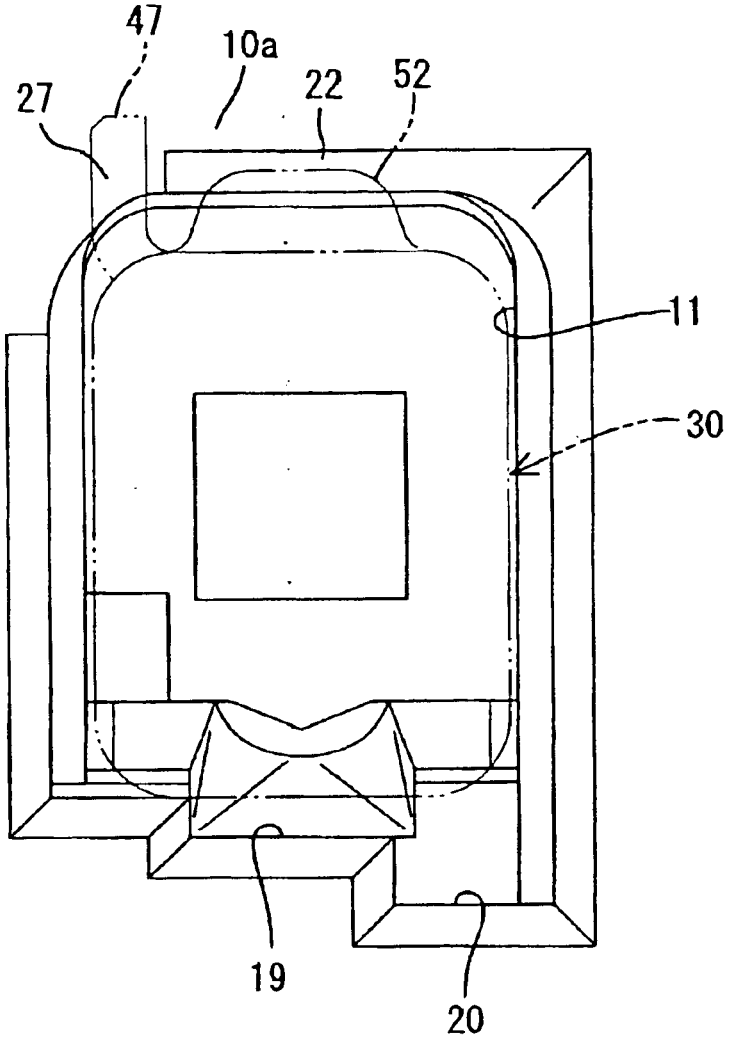
FIG. 17 is a rear view showing a relationship between the inverted female terminal fitting and the cavity.

The locking projection 52 moves beyond the lock 13 when the female terminal fitting 30 reaches a proper depth in the cavity 11. Thus, the lock 13 is restored resiliently and enters the cut-away portion 44 to lock the female terminal fitting 30, as shown in FIGS. 13 to 16. At this time, the projection 25 of the lock 13 projects along the inclination of the cut end surface 44*a* and enters the inside of the locking projection 52. The front end of the main body 31 is pushed down by the jutting portion 21 on the ceiling surface of the cavity 11 and is displaced toward the lock 13 in this process. Thus, the depth of engagement of the lock 13 with the female terminal fitting 30 is increased. Further, the vertical inclination of the female terminal fitting 30 is prevented by the engagement of the supporting projection 26 with the fittable groove 53, as shown in FIG. 15. The locking projection 52 is displaced from both maneuverable recesses 24 of the lock 13 along the widthwise direction and is exposed forward to outside together with the maneuverable recesses 24, as shown in FIG. 17.

The front cut end surface 44*a* of the cut-away portion 44, which is the locking surface engageable with the lock 13, reaches the front portion 37*a* of the outer wall 37 including the locking projection 52 and the front-portion holding piece 50. Thus, the front cut end surface 44*a* is formed over the substantially entire width of the female terminal fitting 30, as shown in FIGS. 12 to 15. As a result, the female terminal fitting 30 is held with a strong locking force and will not come out of the cavity 11. Further, the front cut end surface 44*a* of the cut-away portion 44 is inclined in and up to the back, and the locking force is even stronger.

Figure 18:
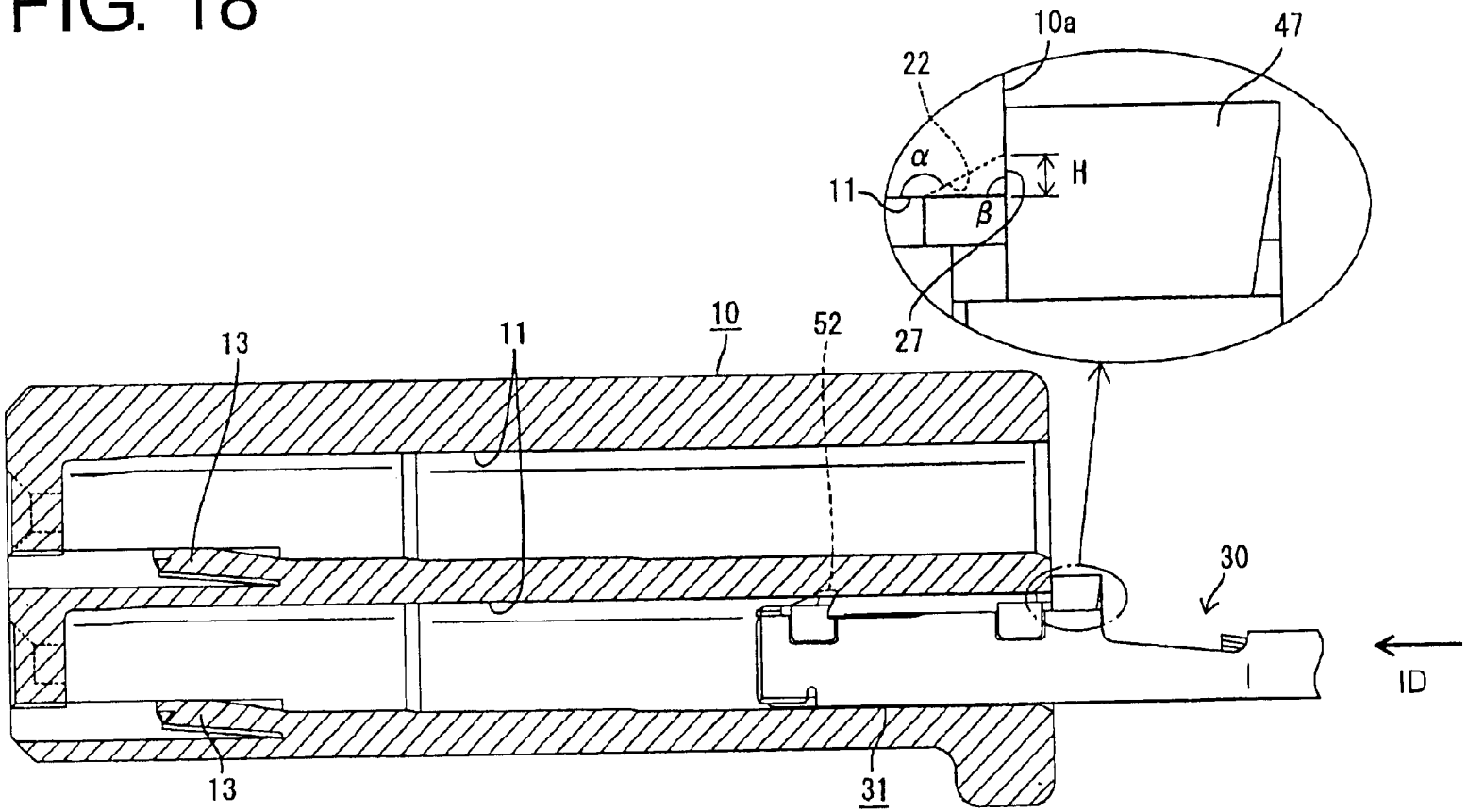
FIG. 18 is a side view in section (the female housing is shown by the section along 8—8 of FIG. 1 and the female terminal fitting is shown by a left side view) in a state where a stabilizer abuts against a preventing surface.

The female terminal fitting 30 may be inverted during an insertion attempt into the cavity 11. In such a case, as shown in FIG. 17, the locking projection 52 and the stabilizer 47 face up, and the projection-inserting groove 19 and the stabilizer-inserting groove 20 are not aligned with each other. Thus, if an attempt is made to insert the terminal fitting 30, the locking projection 52 abuts the upper part of the slanted guide surface 22. However, the slanted guide surface 22 is inclined at an obtuse angle to the inserting direction ID, and the locking projection 52 is tapered toward the front end, as described above. Thus, the locking projection 52 theoretically could smash and bite in the upper edge of the cavity 11 by an inserting force and insertion theoretically is possible. However, the front end surface of the stabilizer 47 contacts the preventing surface 27 at the rear end 10*a* of the female housing 10, as shown in FIG. 18, and further insertion is prevented. At this time, the stabilizer 47 is displaced along the widthwise direction from the slanted guide surface 22 (see FIG. 17). The preventing surface 27 is arranged at a position along the inserting direction ID so that the locking portion 52 cannot bite into the connector housing 10.

The angle β of the preventing surface 27 to the inserting direction ID of the female terminal fitting 30 is smaller than the angle α of the slanted guide surface 22 to the inserting direction ID. Thus, the stabilizer 47 is less likely to be guided into the cavity 11 as compared to prior art connectors with no preventing surface (see FIG. 19). Further, the angle β of the preventing surface 27 is about 90°, and hence the stabilizer 47 comes into surface contact with the preventing surface 27 at the rear end 10*a* of the female housing 10. Thus, a contact area of the stabilizer 47 is increased by the height H of the preventing surface 27 as compared to the prior art connectors and, therefore, the stabilizer 47 is unlikely to bite in the peripheral edge of the cavity 11. In this way, the insertion of the female terminal fitting 30 in an improper posture is prevented securely. The improper posture of the female terminal fitting 30 can be detected based on an inability to insert the female terminal fitting 30. The female terminal fitting 30 then is pulled out of the cavity 11 and inserted again in a proper orientation.

As described above, the stabilizer 47 abuts the preventing surface 27 when the female terminal fitting 30 is oriented improperly. The angle β of the preventing surface 27 with respect to the inserting direction ID of the female terminal fitting 30 is smaller than the angle α of the slanted guide surface 22 to the inserting direction ID. Thus, the stabilizer 47 is unlikely to be guided into the cavity 11, and insertion of the improperly oriented female terminal fitting 30 is prevented.

Figure 19:
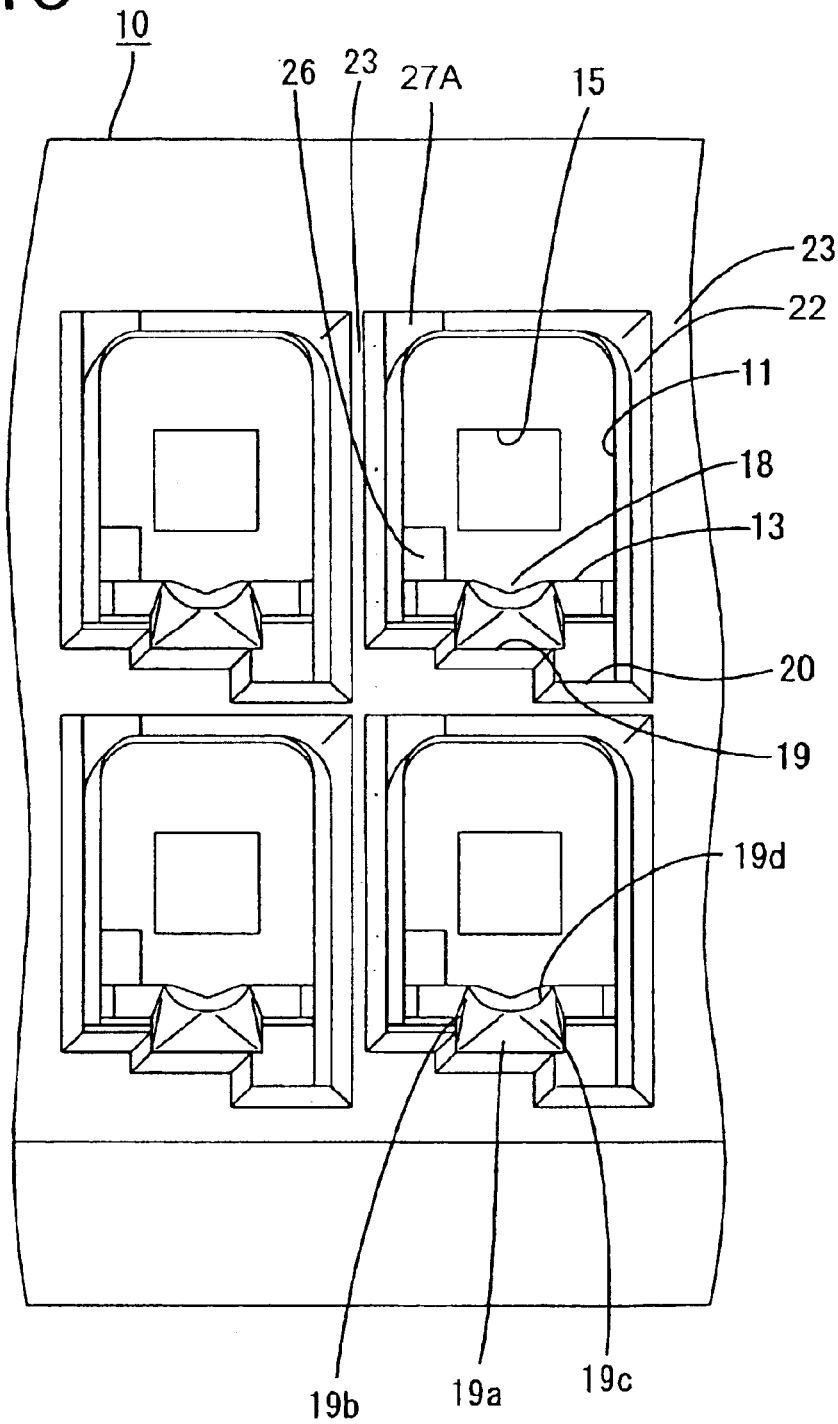
FIG. 19 is a rear view of a female housing according to a further preferred embodiment of the invention.

A further embodiment of the invention is described with reference to FIG. 19. This embodiment is similar to the previous embodiment except for the shape and proportions of the preventing surface 27A. Accordingly, there is no repetitive description of those features that are similar to those of the previous embodiment, and the similar elements are by denoted with the same reference numerals.

The preventing surface 27*a* of the second embodiment is recessed with respect to the back end 10*a* of the connector housing 10 and thus replaces the guide surface 22 in its region. The preventing surface 27A is substantially normal to the inserting direction ID of the terminal fitting 30 into the cavity 11 and hence defines a smaller angle of inclination than the slanted surface 22. The extension of the preventing surface 27A in a direction away from the insertion axis of the terminal fitting into the cavity 11 is substantially the same as that of the guide surface 22. In other words, the preventing surface 27A is formed by recessing a portion of the guide surface 22 point-symmetrical to the stabilizer-inserting groove 20 to form a step therein.

Figure 20A:
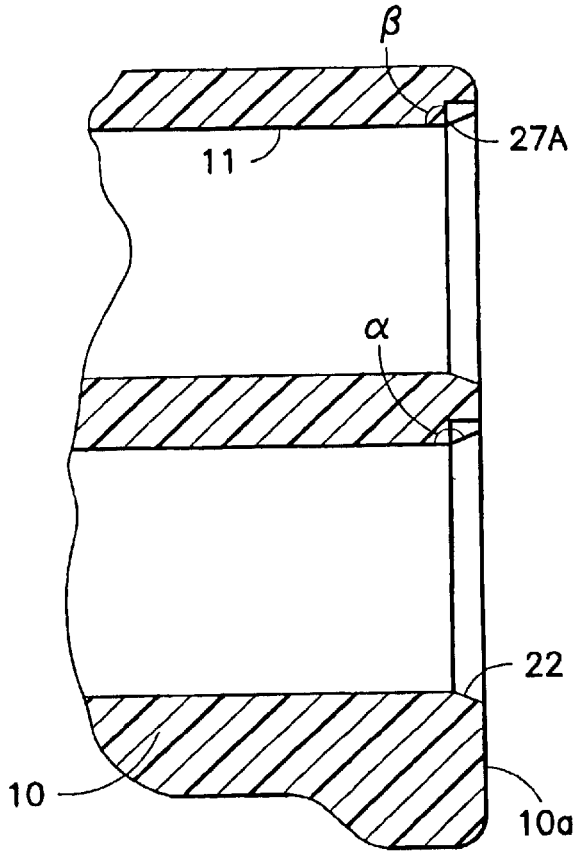
FIGS. 20(A) and (B) are a rear view and a partial sectional view, respectively of a modification of the embodiment shown in FIG. 19.
Figure 20B:
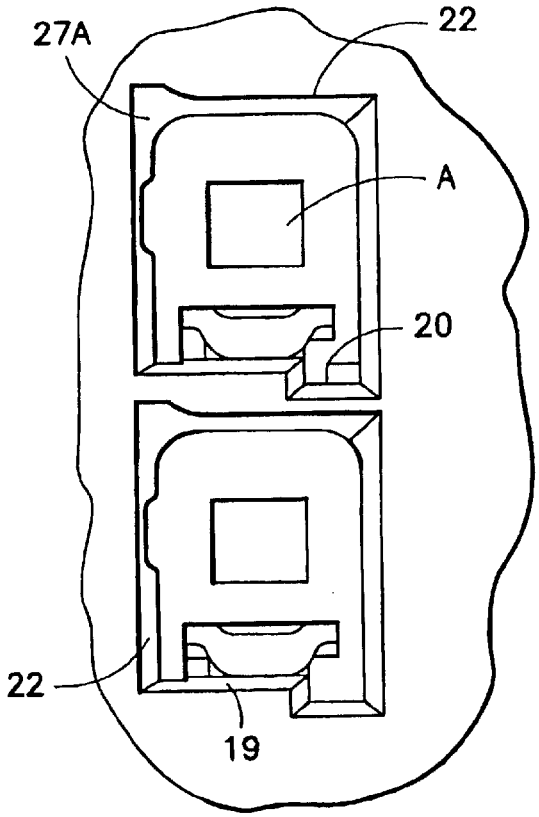
Figure 21:
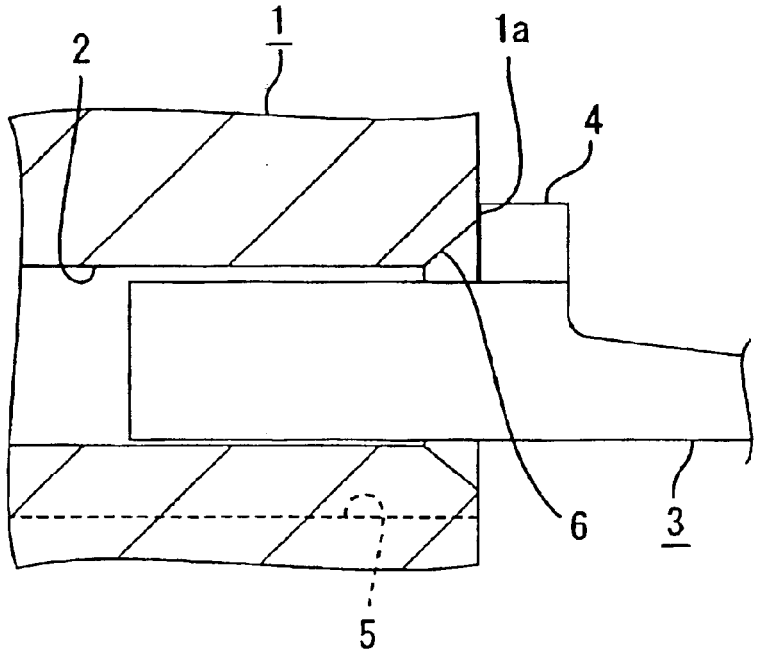
FIG. 21 PRIOR ART
FIG. 21 is a diagram showing a prior art connector.

A modification of the previous preferred embodiment can be seen in FIG. 20. In this embodiment the preventing surface 27A also is stepped back from the back-end surface 10*a* of the connector housing 10 (as can be seen in FIG. 20(A)). This modification differs from the previous embodiment in that the preventing surface 27A projects outward in a direction away from the insertion axis A of the terminal fitting into the cavity 11 as compared with the guide surface 22. Thus, the preventing surface 27A is formed by recessing a portion of the guide surface 22 point-symmetrical to the stabilizer-inserting groove 20 to form a step in the rear-end surface 10*a* of the housing 10. The angle β of the preventing surface 27 to the inserting direction ID of the female terminal fitting 30 is smaller than the angle α of the slanted guide surface 22 to the inserting direction, so that the stabilizer 47 is less likely to be guided into the cavity 11 as compared to prior art connectors with no preventing surface. Furthermore, the angle β of the preventing surface 27 to the inserting direction ID of the female terminal fitting 30 preferably is about 90°.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The angle of the preventing surface to the inserting direction of the female terminal fitting is about 90° in the foregoing embodiment. However, it may be larger than or smaller than or equal to 90° provided that this angle is smaller than the angle of the slanted guide surface. Particularly, if the angle of the preventing surface to the inserting direction of the female terminal fitting is set smaller than 90°, i.e. set to be an acute angle, the stabilizer can be guided to the outside of the cavity. Thus, the insertion of the female terminal fitting in an improper posture can be prevented more securely.

The preventing surface is substantially continuous with the rear end surface of the female housing in the foregoing embodiment. However, it may be more forward than the rear end surface of the female housing, for example, by forming a recess at the peripheral edge of the rear end of the cavity (see FIGS. 10 and 20) and the height thereof may be set in conformity with the projecting distance of the stabilizer.

The height of the stabilizer is larger than the height of the slanted guide surface and the preventing surface in the foregoing embodiment. However, embodiments in which a relationship of these heights is reversed or these heights are all equal also are embraced by the present invention.

The stabilizer is at the rear end of the main body in the foregoing embodiment. However, it can be provided at any desired position.

A female connector provided with female terminal fittings is shown in the foregoing embodiment. However, the present invention is similarly applicable to male connectors with male terminal fittings having tabs.

What is claimed is:

1. A connector with a housing with at least one cavity in which at least one terminal fitting is insertable along an inserting direction, a stabilizer projecting transversely from the terminal fitting, a slanted guide surface being formed at a peripheral edge of an inserting end of the cavity and being slanted at an angle to the inserting direction of the terminal fitting for guiding the terminal fitting into the cavity, a stabilizer-inserting groove formed in an inner surface of the cavity and being open at the inserting end of the cavity, the stabilizer-inserting groove being dimensioned and disposed for receiving the stabilizer of the terminal fitting when the terminal fitting is in a proper rotational orientation, and a preventing surface at the peripheral edge of the inserting end of the cavity and aligned at an angle to the inserting direction that is less than the angle of the slanted guide surface to the inserting direction, the preventing surface being dimensioned and disposed to abut the stabilizer when the terminal fitting is inserted in an improper posture.

2. The connector of claim 1, wherein the slanted guide surface is slanted at an obtuse angle to the inserting direction of the terminal fitting.

3. The connector of claim 1, wherein the preventing surface is arranged point-symmetrical with respect to the stabilizer-inserting groove.

4. The connector of claim 1, wherein the angle of the preventing portion is about 90° with respect to the inserting direction, so that the stabilizer can come substantially into surface contact with the preventing surface.

5. The connector of claim 1, wherein the preventing portion and an inserting side end surface of the housing are substantially continuous and flush with each other.

6. The connector of claim 1, wherein the preventing portion is arranged to contact the stabilizer in a way as to avoid a contact of a locking projection of the terminal fitting with the connector housing when the terminal fitting is oriented improperly.

7. A connector with a housing having opposite front and rear ends and at least one cavity extending along an inserting direction between the ends, a slanted guide surface being formed at the rear end of the housing and extending substantially around a peripheral edge of the cavity, the slanted guide surface being slanted at an angle to the inserting direction, a stabilizer-inserting groove formed in an inner surface of the cavity and being open at the rear end of the housing, and a preventing surface at the rear end of the housing and at the peripheral edge of the cavity, the preventing surface being aligned at an angle to the inserting direction that is less than the angle of the slanted guide surface to the inserting direction.

8. The connector of claim 7, wherein the slanted guide surface is slanted at an obtuse angle to the inserting direction.

9. The connector of claim 7, wherein the preventing surface is arranged point-symmetrical with respect to the stabilizer-inserting groove.

10. The connector of claim 7, wherein the angle of the preventing portion is about 90° with respect to the inserting direction.

11. The connector of claim 7, wherein the preventing portion and the rear end of the housing are substantially continuous and flush with each other.

* * * * *